US005887226A

United States Patent [19]

Taki

[11] Patent Number: 5,887,226

[45] Date of Patent: Mar. 23, 1999

[54] COOLING DEVICE USED IN IMAGE FORMING DEVICE

[75] Inventor: Eiji Taki, Ichinomiya, Japan

[73] Assignee: Brother Kogyo Kabushiki Kaisha, Nagoya, Japan

[21] Appl. No.: 961,012

[22] Filed: Oct. 30, 1997

[30] Foreign Application Priority Data

Nov. 7, 1996 [JP] Japan ..... 8-294973

[51] Int. Cl.[6] ..... G03G 21/20

[52] U.S. Cl. ..... 399/92

[58] Field of Search ..... 399/91, 92, 111, 399/320

[56] References Cited

U.S. PATENT DOCUMENTS 5,038,170 8/1991 Serita ..... 399/92
5,166,727 11/1992 Miyamoto et al. ..... 399/92
5,390,006 2/1995 Wakabayashi et al. ..... 399/92
5,479,242 12/1995 Sato et al. ..... 399/92

*Primary Examiner*—William Royer
*Attorney, Agent, or Firm*—Oliff & Berridge, PLC

[57] ABSTRACT

A cooling unit is provided to an image forming device. The image forming device includes a process unit having a photosensitive body on which is formed an electrostatic latent image and a developing unit for forming a toner image on the photosensitive body based on the electrostatic latent image; a transfer unit that transfers the toner image onto a sheet; and a fixing unit that thermally fixes the toner image onto the sheet, the process unit and the fixing unit having facing surfaces that face each other. The cooling unit itself includes: an airflow duct disposed between the facing surfaces of the process unit and the fixing unit and formed with at least either process-unit-side holes facing the process unit or fixing-unit-side holes facing the fixing unit; and a cooling fan that draws air from around a corresponding one of the process unit and the fixing unit through the process-unit-side, the fixing-unit-side holes, or both, through the airflow duct, and out of the image forming device.

28 Claims, 9 Drawing Sheets

COOLING DEVICE USED IN IMAGE FORMING DEVICE

BACKGROUND OF THE INVENTION

1. Field of the Invention

The present invention relates to configuration of a cooling device used in an image forming device such as a copy machine, a facsimile machine, and a laser printer.

2. Description of the Related Art

Conventionally, such an image forming device includes: a sheet-supply unit for supplying sheets on which an image is to be formed; a process unit including a photosensitive drum and a developing device for forming a toner image on the photosensitive drum; an exposure unit for forming an electrostatic latent image on the photosensitive drum; a transfer unit for transferring the toner image onto a sheet; a fixing unit for thermally fixing the toner image onto the sheet; a drive motor for rotatingly driving components in the above-described units; transmission gears; and a power source for supplying power to a control unit.

The above-described components, such as components related to drive of the device and the power source portion, are mounted in a housing case formed from metal plate or a compound resin. Conventionally, a cooling fan is provided in the housing case in order to cool off heat generated by the power source, the drive motor, the thermal-type fixing unit, and the like. The cooling fan draws air from outside of the device via an inlet vent and discharges the air out of the device via an outlet vent.

SUMMARY OF THE INVENTION

However, when a plurality of heat sources are disposed separated from each other at differing levels in the housing case, it is difficult to direct air flow generated by a single cooling fan in a plurality of directions throughout the housing case to cool all the heat sources. As a result, a separate cooling fan has to be provided in the vicinity of each heat source. Further, because the fixing unit generates a great amount of heat, it requires its own separate cooling fan to exhaust the heat out of the image forming device. All the separate cooling fans increase manufacturing costs of the image forming device and also require additional space so that the device has to be made bigger.

It is an objective of the present invention to overcome the above-described problems and to provide a cooling device capable of effectively cooling off a plurality of heat sources by using a single cooling fan.

A cooling unit according to the present invention is provided to an image forming device. The image forming device includes: a process unit having a photosensitive body on which is formed an electrostatic latent image and a developing unit for forming a toner image on the photosensitive body based on the electrostatic latent image; a transfer unit that transfers the toner image onto a sheet; and a fixing unit that thermally fixes the toner image onto the sheet, the process unit and the fixing unit having facing surfaces that face each other.

The cooling unit itself includes: an airflow duct disposed between the facing surfaces of the process unit and the fixing unit, the airflow duct being formed with at least either process-unit-side holes facing the process unit or fixing-unit-side holes facing the fixing unit; and a cooling fan that draws air from around the process unit and the fixing unit through the process-unit-side and fixing-unit-side holes, through the airflow duct, and out of the image forming device.

With this configuration, air drawn from the vicinity of the fixing unit and the process unit through the airflow duct removes heat generated by these components, thereby cooling them down. Further, the airflow duct separates the fixing unit, which generates a great deal of heat, from the process unit, which is affected by heat. Because the airflow duct blocks radiant heat generated by the fixing unit, cooling effects of the device are enhanced. It is desirable that a heat-reflecting material be provided to cover the surface of the airflow duct facing the fixing unit so that radiant heat generated by the fixing unit can be even more reliably prevented from being transmitted to the process unit.

According to another aspect of the present invention, a housing case that houses components of the image forming device is formed with an inlet vent and an outlet vent that confront different lengthwise ends of the airflow duct. The cooling fan is disposed adjacent to the outlet vent so as to blow air out of the housing case through the outlet vent. With this configuration, the cooling fan draws air not only through the airflow duct, but also in through the inlet vent.

In this case it is desirable that the lengthwise end of the airflow duct facing the inlet vent be sealed or that the airflow duct, the process unit, and the fixing unit be arranged to form an air passage from the inlet vent to the outlet vent. In these cases, air drawn in through the inlet vent will bypass the airflow duct and flow in a substantially linear manner over the fixing unit, thereby drawing heat off the fixing unit.

It is further desirable that a separation wall be provided for forming a cooling fan housing area between itself and a lateral side of the housing case. In this situation, the separation wall can be formed with through holes for bringing the cooling fan housing area into fluid communication with the air passage and with the airflow duct. The air flow will be discharged from the outlet vent via the through holes formed in the separation wall. Therefore, hot air will not remain in the housing case so that the heat will not affect the process unit.

According to another aspect of the present invention, an inlet vent is formed in a lateral side of the housing that is disposed substantially perpendicular to the lateral side in which the outlet vent is formed.

With this configuration, the cooling fan also draws air from the rear of the image forming device past the process unit. It is desirable that the inlet vent be disposed diagonally to the outlet vent so that air drawn in through the inlet vent by the cooling fan passes over a greater area of the process unit en route to the outlet vent. It is also desirable that the housing be formed so that the cooling fan draws air from the rear inlet vent to both above and below the process unit to maximize cooling effects. In this case, the air flowing above the process unit can be exhausted directly to the outlet vent. The air flowing below the process unit can be exhausted via the process-unit-side holes formed in the airflow duct. To prevent air flowing above and below the process unit from colliding near the fixing unit, it is desirable to provide a separation member between the process unit and the surface of the airflow duct above the process-unit-side holes so that air flowing from under the process unit will all flow into the process-unit-side holes.

This aspect of the invention can be enhanced when inlet vents are formed in lateral sides both facing and perpendicular to the lateral side in which the outlet vent is formed. In this case, the cooling fan generates air streams that flow in between the fixing unit and the process unit and also above and below the process unit, but that will not collide with each other, through almost all areas of the housing case.

In this way, a plurality of heat sources positioned separated from each other can be effectively cooled off by a single cooling fan. Also, manufacturing costs can be reduced by providing fewer cooling fans.

According to another aspect of the present invention, a partition is provided for separating a power source circuit board and other circuit boards from image forming units disposed thereabove. Also, a bottom plate is provided for forming, in cooperation with the partition, an air passage in which the power source and other circuit boards are disposed at the lower portion of the housing case. This configuration protects the power source and other circuit boards from being adversely affected by radiant heat from the image forming units. Additionally, this configuration enables easy formation of an air passage through which cooling air can be drawn using the cooling fan to reliably cool off the circuit boards.

According to another aspect of the present invention, an opening is formed in the front surface of the housing case. The cooling fan draws air in through the opening so that the air flows below the fixing unit, thereby cooling the fixing unit, before entering the fixing-unit-side holes of the airflow duct. This cooling effect can be further improved when the partition extends to below the fixing unit, thereby forming an air passage between the partition and the fixing unit for guiding air from the opening to flow close to the fixing unit.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
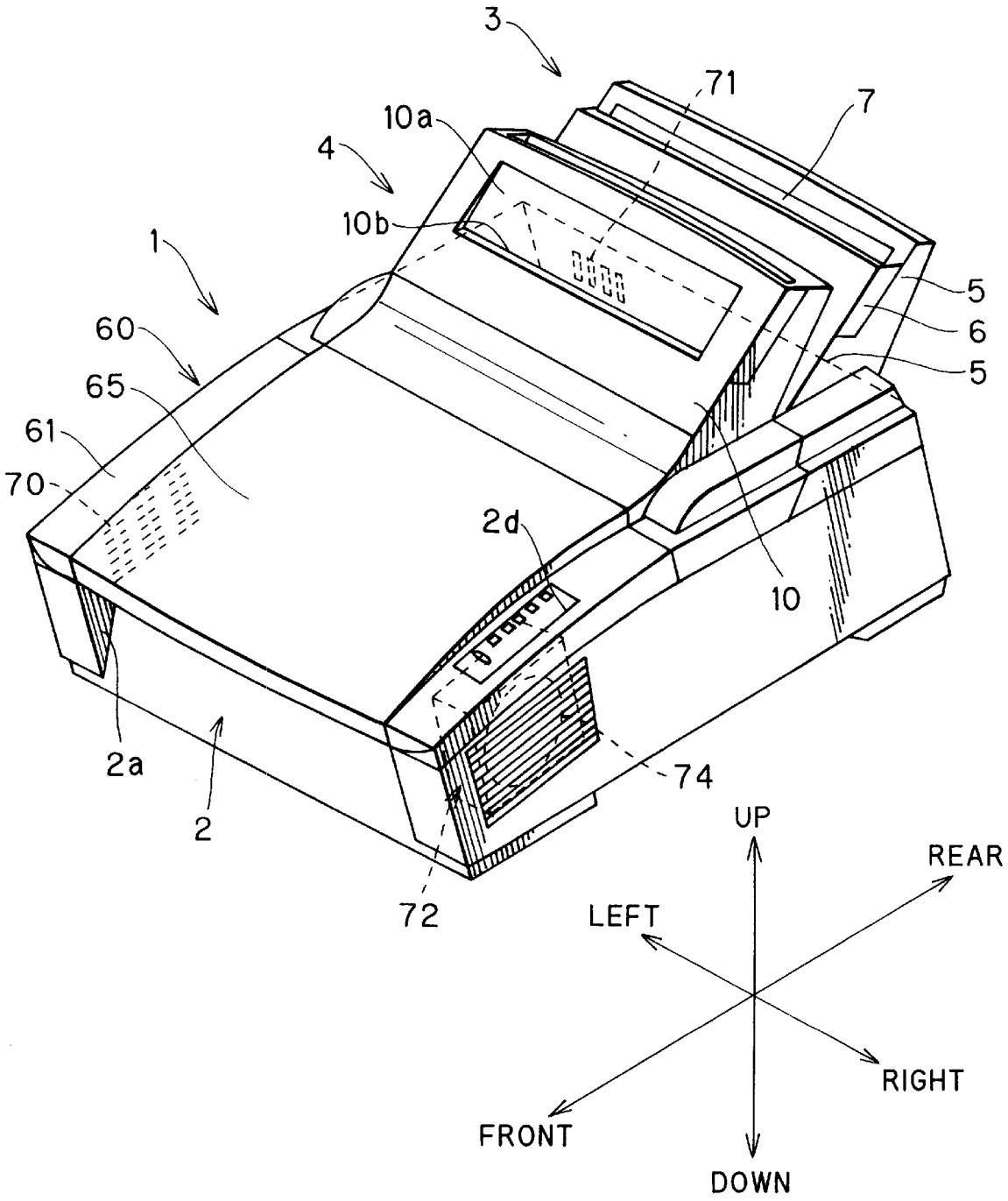
FIG. 1 is a perspective view showing a printer according to an embodiment of the present invention.

A cooling device according to a preferred embodiment of the present invention will be described while referring to the accompanying drawings wherein like parts and components are designated by the same reference numerals to avoid duplicating description.

Figure 2:
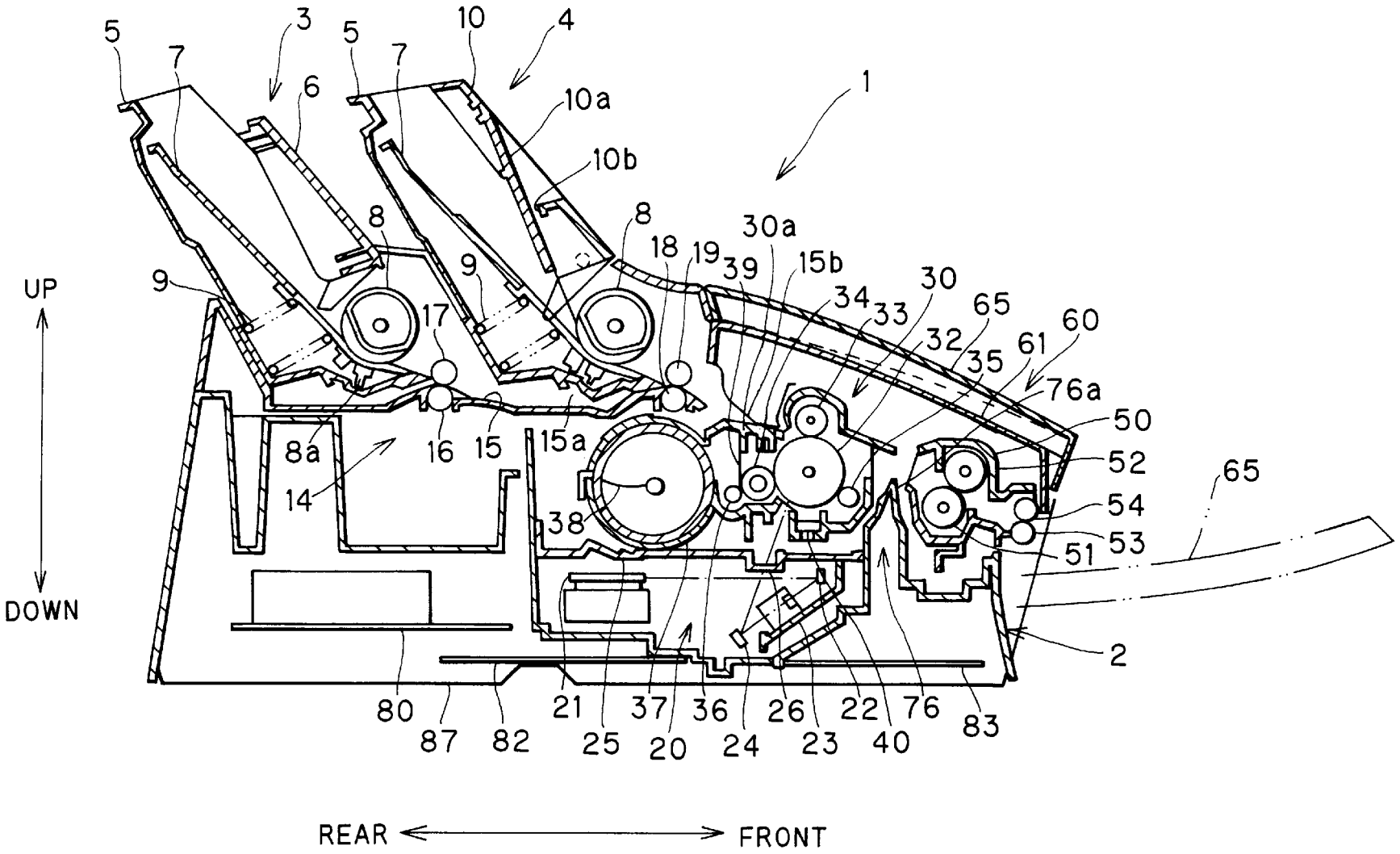
FIG. 2 is a cross-sectional view schematically showing essential components of the printer of FIG. 1.

Next, an explanation will be provided for an embodiment of the present invention used in a laser-beam type printer 1. FIG. 1 is a perspective view showing the printer 1, which serves as an image forming device. FIG. 2 is a cross-sectional view showing Internal configuration of the printer 1.

As shown in FIG. 1, the printer 1 includes: a housing case 2 formed from a compound resin; a first and second sheet-supply tray units 3 and 4, both detachably provided to the rear of the upper surface of the housing case 2; a top cover 61; a cover mechanism 60; and an operation panel 2*d*. The top cover 61, the cover mechanism 60 and the operation panel 2*d* are provided on the upper surface of the housing case 2. The operation panel 2*d* is disposed facing upward on the forward right of the housing case 2. The top cover 61 is capable of selectively covering and uncovering upper portions of the fixing unit 50 and the process unit 30. The cover mechanism 60 includes a sheet-discharge tray 65 that can be opened forward or folded above the upper surface of the top cover 61 while not in use.

As shown in FIG. 2, the housing case 2 of the printer 1 houses: a sheet-transporting mechanism 14; a scanner unit 20 serving as an exposure unit; a process unit 30 including a photosensitive drum 32 and a developing roller 34; and a fixing unit 50 including a heating roller 51 and a pressing roller 52. Although not shown in the drawings, the printer 1 also includes a drive mechanism having gear trains and a drive motor for driving the sheet-transporting mechanism 14, the process unit 30, the fixing unit 50, and the like; and a cooling unit to be described later.

As shown in FIGS. 1 and 2, the first sheet-supply tray unit 3 includes: a tray body 5; a tray cover 6 openably connected to the tray body 5; a sheet-support plate 7 freely, pivotably supported on the tray body 5; a sheet-supply roller 8 to be rotated by drive force transmitted from the drive unit; a separation pad 8*a*; and an urging spring 9 for urging the lower edge of the sheet-support plate 7 toward the sheet-supply roller 8. Although not shown in the drawings, when the tray cover 6 is opened, a releasing mechanism pivots the lower end of sheet-support plate 7 against urging force of the urging spring 9 around toward the bottom of the tray body 5 so that sheets can be set on the sheet-support plate 7.

Configuration of the second sheet-supply tray unit 4 is substantially the same as that of the first sheet-supply tray unit 3. Therefore, the same numbers are given to the same components and explanation for them will be omitted. It should be noted that a guide portion 10*a* is provided to a tray cover 10 to also enable manual supply of sheets through a slot between guide portion 10*a* and guide 10*b*.

The sheet-transporting mechanism 14 includes: a slanting surface 15 extending from the lower edges of the first and second sheet-supply tray units 3, 4 to above the process unit 30; a pair of sheet-supply rollers 16, 17; and a pair of resist rollers 18, 19 for aligning the front edge of each supplied sheet. Although not shown in the drawings, sheets stacked on the sheet-support plate 7 of the second sheet-supply tray unit 4 are separated one by one from the stack by the sheet-supply roller 8 rotating against the separation pad 8*a*. Each thus-separated sheet then abuts against the resist rollers 18, 19 so that its front edge is aligned. The resist rollers 18, 19 then transport the sheet.

The scanner unit 20, which serves as an exposure unit, includes an upper support plate 25 formed from a compound resin. The scanner unit 20 includes a laser-light emitting portion not shown in the drawings, a polygon mirror 21, a lens 23, and reflecting mirrors 22, 24 under the upper support plate 25. A scanner slit is formed in the upper support plate 25 so as to extend parallel with the rotational axis of the photosensitive drum 32 of the process unit 30. The scanner aperture is covered with a glass plate 26. A laser beam emitted from the scanner unit 20 passes through the glass plate 26 and irradiates the outer peripheral surface of the photosensitive drum 32, thereby performing an exposure process for forming an electrostatic latent image on the surface of the photosensitive drum 32.

As shown in FIG. 2, the process unit 30 includes a compound resin case 30*a* for housing other components of the process unit 30 in a modular cartridge-like arrangement. The process unit 30 further includes: the photosensitive drum 32; a transposing roller 33 which contacts the upper surface of the photosensitive drum 32; a scorotoron or other type of charge unit 40 disposed under the photosensitive drum 32; a developing unit having the developing roller 34 and a toner-supply roller 36, both disposed upstream from the transposing roller 33 with respect to rotational direction of the photosensitive drum 32; a developing agent (toner) supply portion that has a detachable toner cartridge 37 and an agitation member 38 and that is disposed opposite the photosensitive drum 32 with the developing unit interposed therebetween; and a cleaning roller 35 disposed downstream from the transposing roller 33 with respect to rotational direction of the photosensitive drum 32.

With this configuration, sheets set on the first sheet-supply tray unit 3 are first transported one by one by the sheet-supply rollers 16, 17 along a transporting pathway 15*a* defined by the slanting surface 15. Then the front edge of each sheet is aligned by the resist rollers 18, 19. Each sheet is further transported via a transporting pathway 15*b* into the process unit 30, where a toner image is formed on the sheet in the following manner.

The charge unit 40 forms a uniform charge layer on the outer peripheral surface of the photosensitive drum 32. The scanner unit 20 forms an electrostatic latent image in the charge layer by scanningly emitting a laser beam. The agitation member 38 agitates the developing agent (toner) in the toner cartridge 37 and emits the toner from the toner cartridge 37. The toner-supply, roller 36 coats the outer peripheral surface of the developing roller 34 with the emitted toner in a thickness regulated by a blade 39. The developing agent (toner) supplied from the developing roller 34 clings to the electrostatic latent image formed on the photosensitive drum 32, thereby developing the image. The developed image is transposed onto a sheet transported between the transposing roller 33 and the photosensitive drum 32. Afterward, the cleaning roller 35 cleans any residual toner from the photosensitive drum 32.

Next, the sheet is transported to the fixing unit 50, where the heating roller 51 and the pressing roller 52 fix the toner image on the sheet. The sheet is then discharged onto the sheet-discharge tray 65 with the aid of rollers 53, 54.

Next, the housing case 2 and configuration of an air-cooled type cooling device according to the embodiment of the present invention will be explained while referring to FIGS. 1 and 3 to 9.

Figure 6:
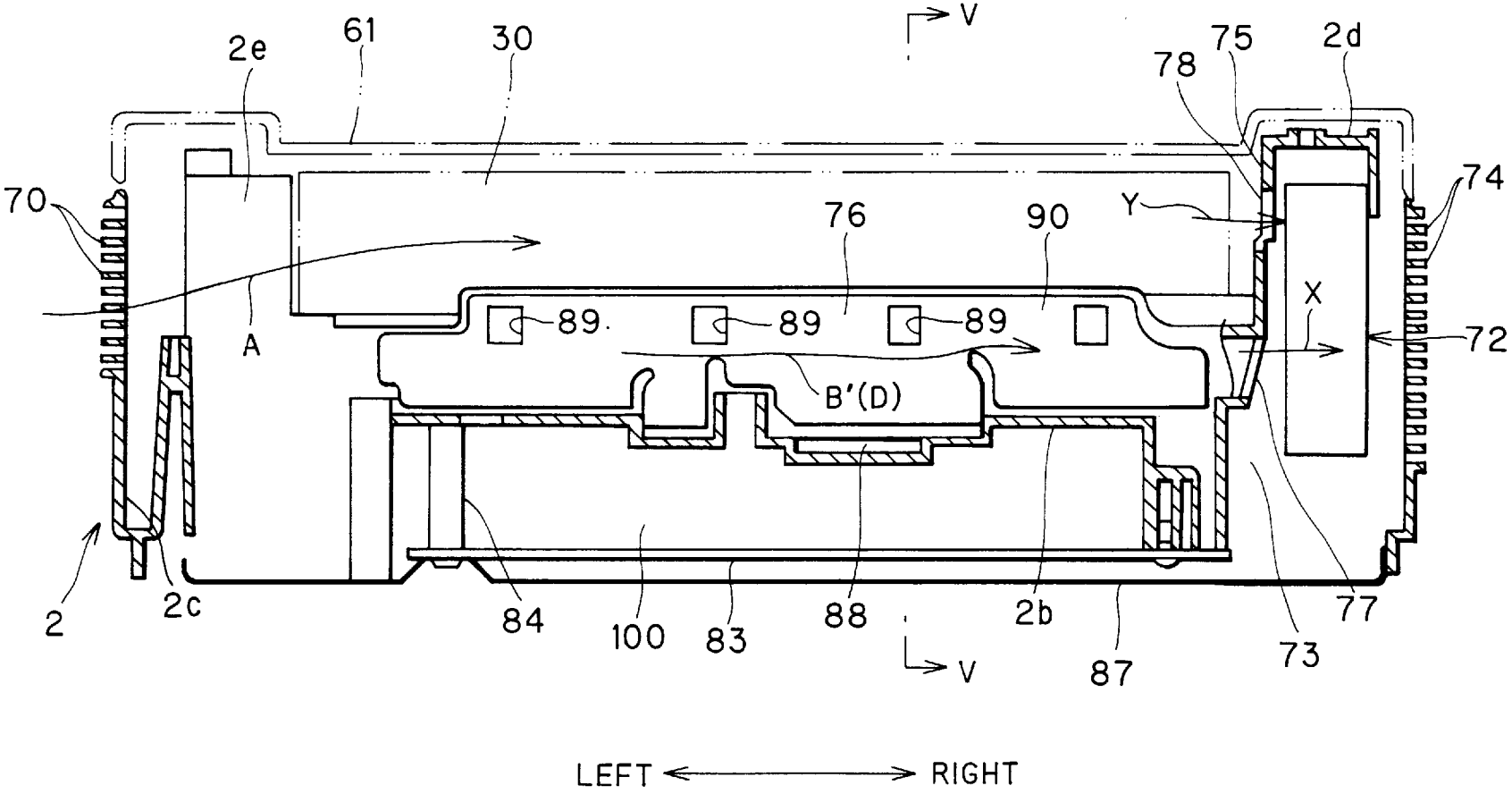
FIG. 6 is a cross-sectional view taken along line VI—VI of FIG. 3.

The housing case 2 includes several sections integrally formed from, for example, a compound resin by injection molding or other method. The housing case 2 includes: a main frame 2*a*; a front, rear, left, and right outer-cover lateral sides 2*c* for covering the four outer surfaces, that is, front, rear, left, and right surfaces, of the main frame 2*a*; and a lower partition 2*b* of the main frame 2*a*. The housing case 2 also includes the operation panel 2*d* and a storage recess 2*e*. As shown in FIG. 6, the storage recess 2*e* has an opening facing downward for storing a drive mechanism not shown in the drawings.

Figure 3:
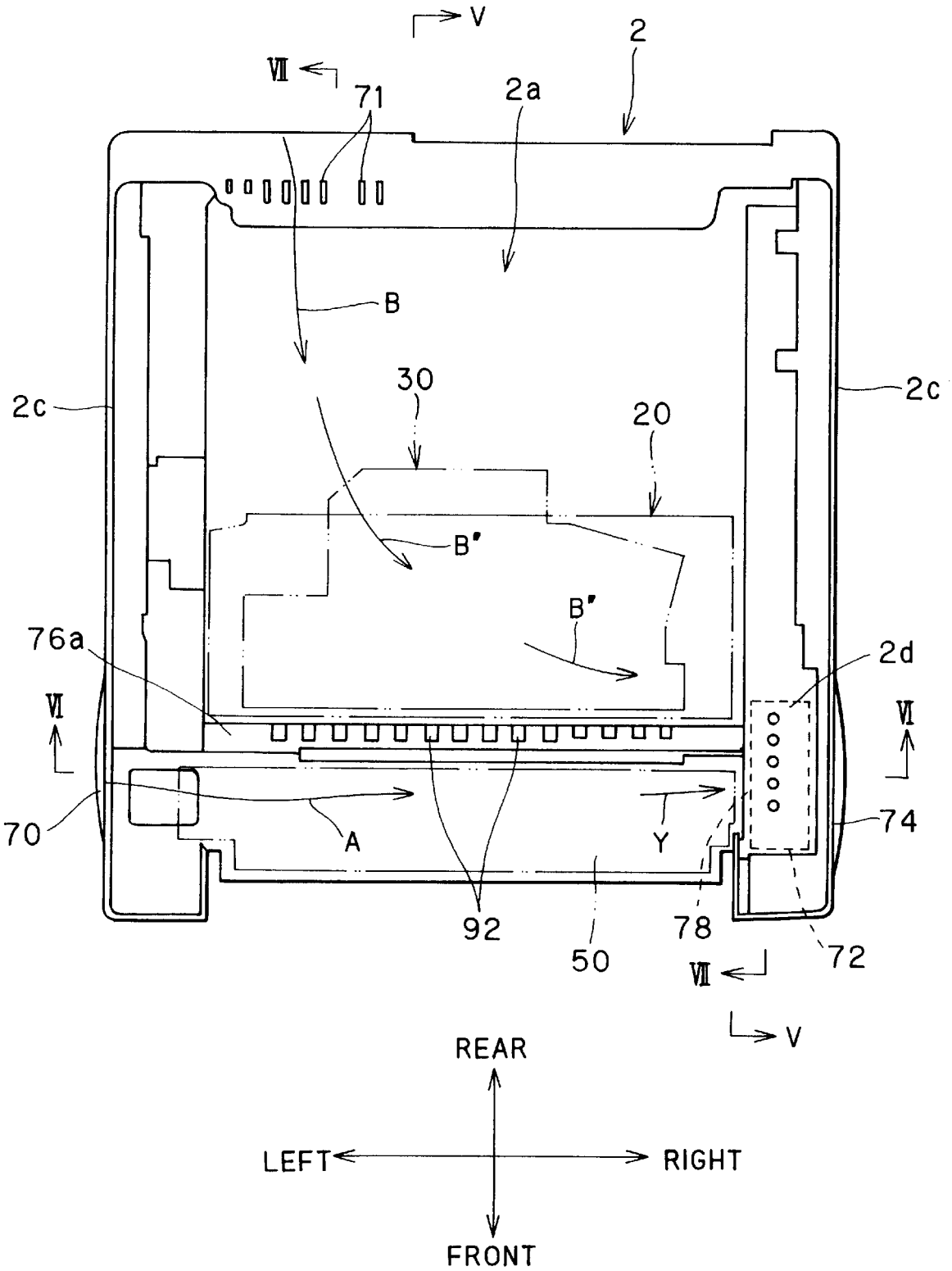
FIG. 3 is a plan view schematically showing the upper surface of a housing case of the printer.
Figure 5:
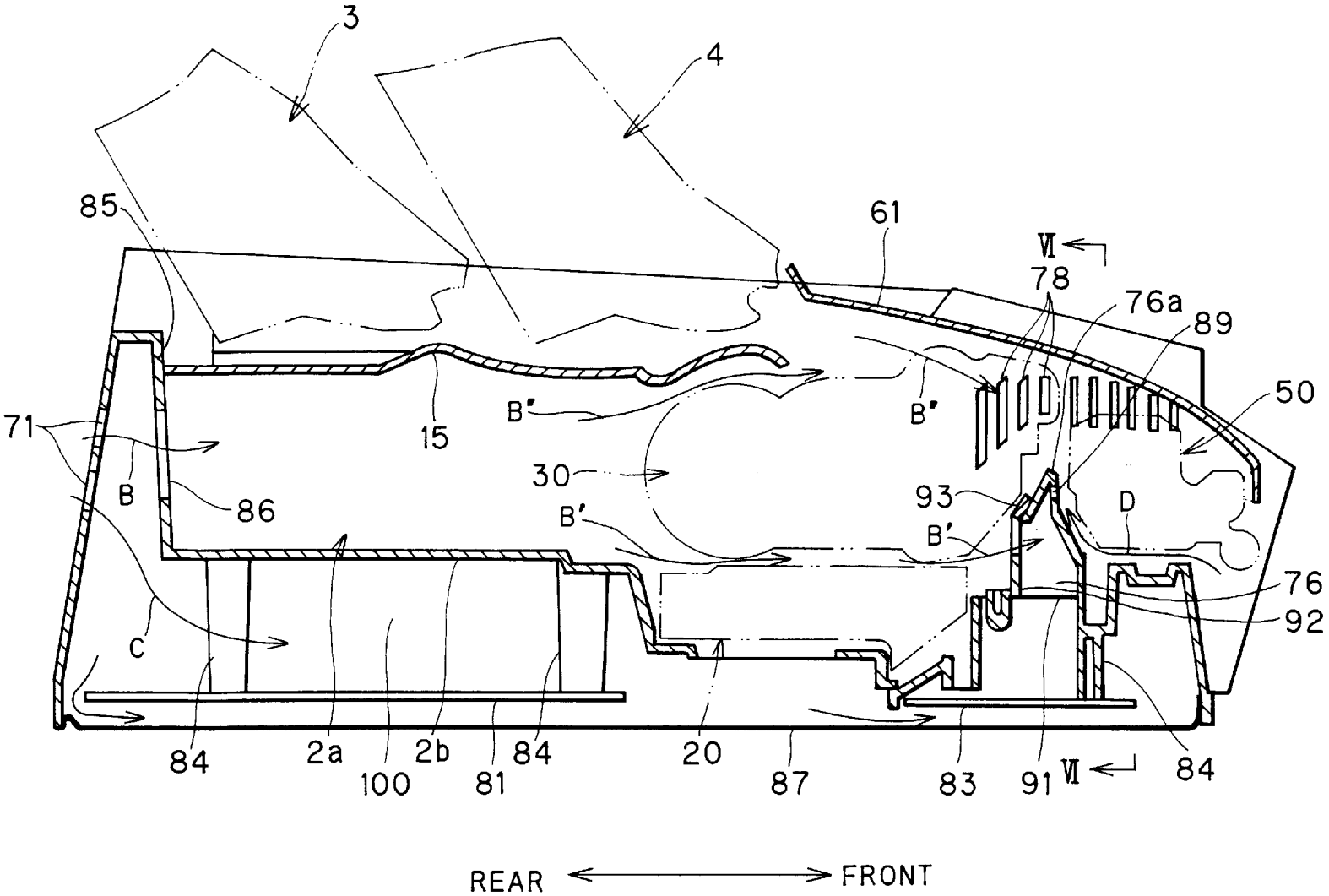
FIG. 5 is a cross-sectional view taken along line V—V of FIG. 3.

The main frame 2*a* has substantially a rectangular-box shape with an opening facing upward and is, as shown in FIG. 3, positioned at the substantial center of the housing case 2. The main frame 2*a* supports the scanner unit 20, the process unit 30, and the fixing unit 50 in a freely detachable manner. As shown in FIG. 5, the scanner unit 20 and the process unit 30 are positioned at substantially the center of the main frame 2*a* of the housing case 2 with the process unit 30 disposed above the scanner unit 20.

The outer-cover lateral sides 2*c* are connected with the four outer peripheral surfaces of the main frame 2*a*. As shown in FIG. 1, a first inlet vent 70 is formed in the forward end of the left outer-cover lateral side 2*c*. A second inlet vent 71 is formed in the leftward end of the rear outer-cover lateral side 2*c*. As shown in FIGS. 1 and 5, an outlet vent 74 is formed in the forward end of the right outer-cover lateral side 2*c*. As shown in FIG. 5, the rear portion of the lower partition 2*b* bends upward, thereby forming a rear wall 85. A rear-side intake hole 86 is formed on the rear wall 85 adjacent to the outlet vent 74.

As shown in FIG. 6, a separation wall 75 is disposed to the left of the right outer-cover lateral side 2*c*, thereby forming a cooling fan housing portion 73 under the operation panel 2*d* and in the vicinity of the outlet vent 74. A cooling fan 72 is housed in the cooling fan housing portion 73 and is disposed so as to discharge air out of the outlet vent 74. Although the separation wall 75 in general separates the interiors of the main frame 2*a* and of the cooling fan housing portion 73, a plurality of openings 78 and a connecting passage 77 are formed in the separation wall 75. The plurality of openings 78 are formed in the separation wall 75 in confrontation with the outlet vent 74 so that air from the main frame 2*a* can flow into the cooling fan housing portion 73 via the openings 78.

The connecting passage 77 is formed in the separation wall 75 at a position below the openings 78. As best seen in FIGS. 5 and 6, an airflow duct 76 extends from the connecting passage 77 in a direction perpendicular to a sheet-feed direction, that is, leftward and rightward, between facing surfaces of the process unit 30 and the fixing unit 50. Although the airflow duct 76 is rectangular shaped as viewed in FIG. 6, it has a tube-like shape in cross-section, as can be seen in FIG. 5. The airflow duct 76 is connected to the connecting passage 77 so that air can pass from the airflow duct 76 into the cooling fan housing portion 73.

Figure 8:
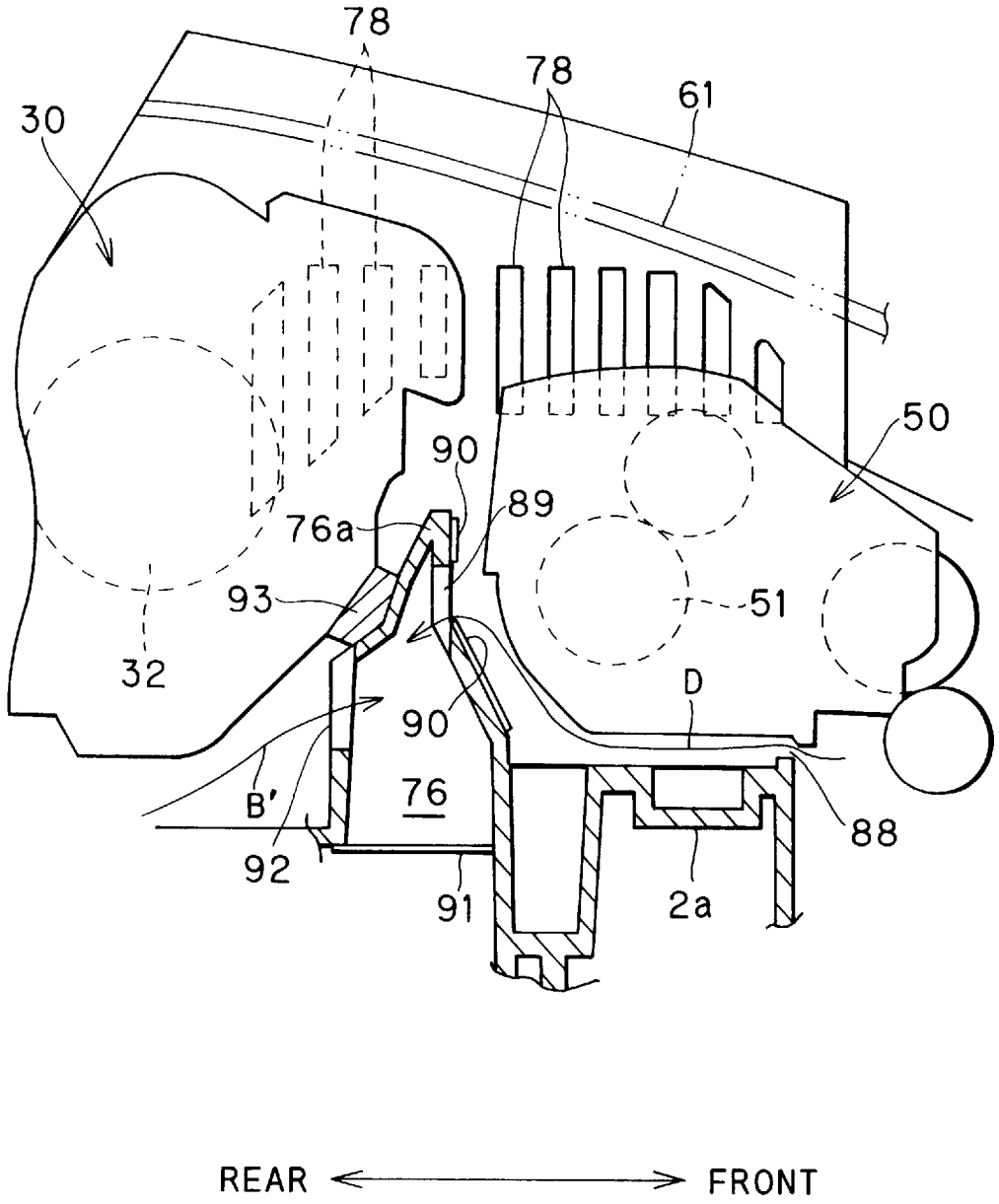
FIG. 8 is a cross-sectional detail of FIG. 5 showing configuration around an airflow duct according to the present embodiment.
Figure 9:
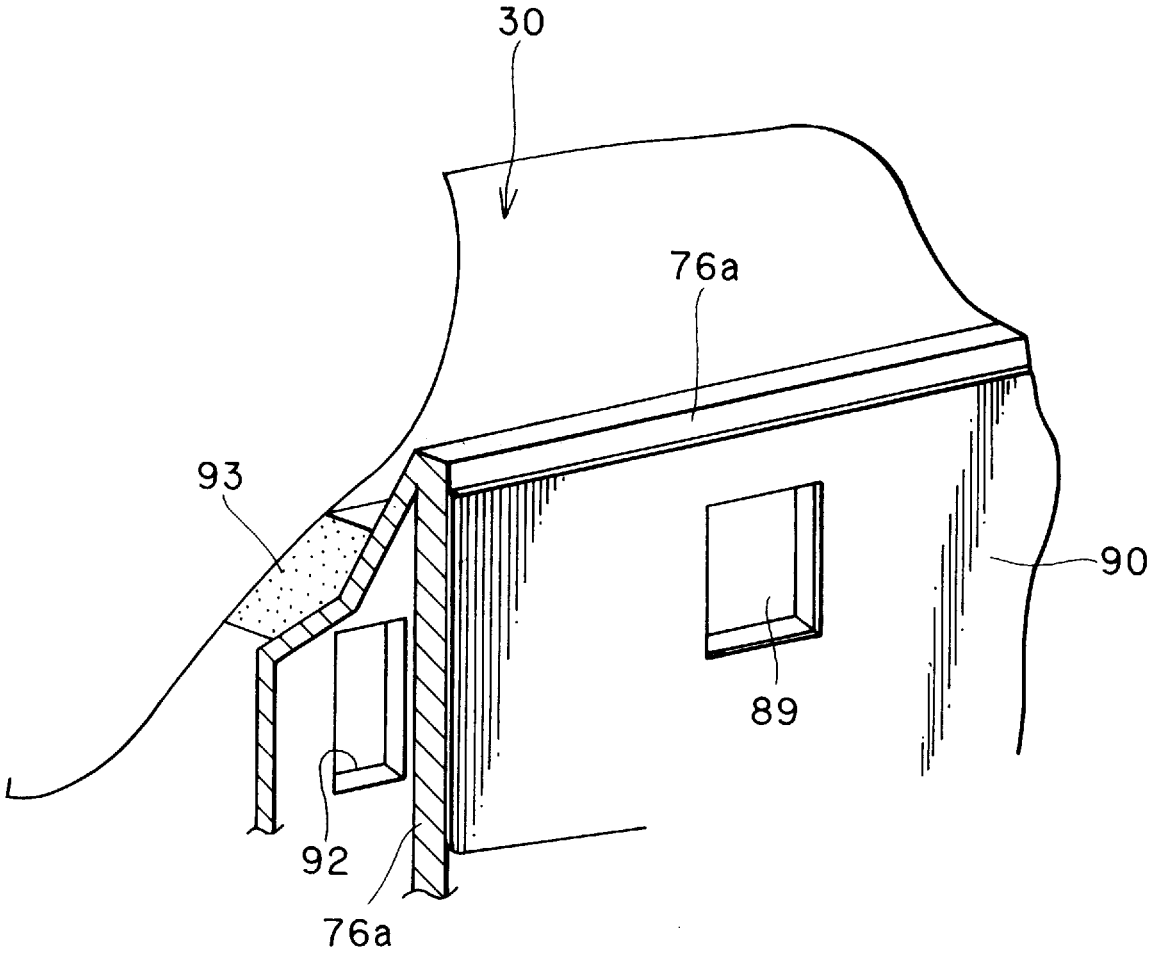
FIG. 9 is a perspective detail showing the airflow duct.

As shown in FIGS. 5, 8, and 9, the airflow duct 76 is formed from an upper surface plate 76*a* and a partition 91 connected to lower edges of the upper surface plate 76*a*. The upper surface plate 76*a* is formed in a substantially inverted V shape in cross section and is positioned between the process unit 30 and the fixing unit 50, which are disposed on the main frame 2*a* as mentioned above. The upper surface plate 76*a* is formed at its front surface with a plurality of fixing-unit-side intake holes 89 and in its lower rear surface with process-unit-side intake holes 92.

As shown in FIGS. 8 and 9, a heat-reflecting plate 90 is provided to cover most of the front surface of the upper surface plate 76*a*, that is, the surface confronting the rear surface of the fixing unit 50 except the plurality of fixing-unit-side intake holes 89. The heat-reflecting plate 90 is formed from aluminum foil, for example. Because the upper surface plate 76*a* is disposed between the process unit 30 and the fixing unit 50 and because the heat-reflecting plate 90 is provided on the surface of the surface plate 76*a* facing the fixing unit 50, radiant heat from the heating roller 51 of the fixing unit 50 is prevented from being transmitted directly to the process unit 30.

As shown in FIGS. 6 and 8, a rectangular-shaped cut-out portion 88 is formed to an appropriate width near the widthwise center in the front surface of the housing case 2. The cut-out portion 88 brings the front portion of the printer 1 into fluid communication with the area under the fixing unit 50 and the fixing-unit-side intake holes 89.

A dividing member 93 is disposed at the rear surface of the upper surface plate 76*a*. The dividing member 93 is formed into a substantially rectangular shape from a sponge-like material. The dividing member 93 extends leftward and rightward above the process-unit-side intake holes 92 so as to separate the area between the front surface of the process unit 30 and the rear surface of the airflow duct 76 into upper and lower portions.

Figure 7:
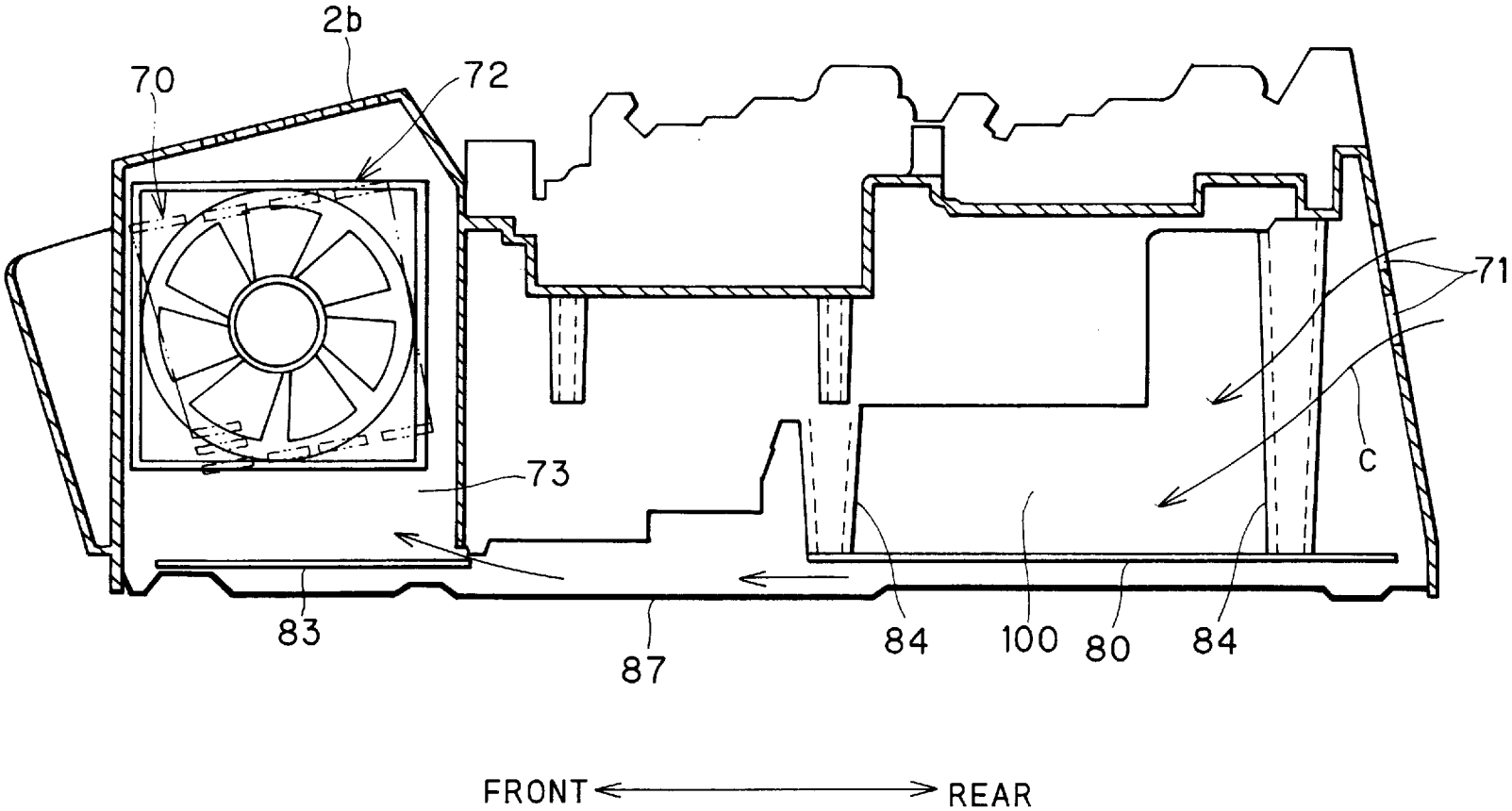
FIG. 7 is a cross-sectional view taken along line VII—VII of FIG. 3.

As shown in FIGS. 5 through 7, a bottom plate 87 formed from, for example, metal sheet is fixed by screws to the lower edges of the housing case 2. A lower compartment 100 is defined by the bottom plate 87 and the lower partition 2*b* of the main frame 2*a*. A variety of circuit boards are disposed in the lower compartment 100 and so are separated from image forming components, such as the process unit 30 and the fixing unit 50, of the printer 1 by the lower partition 2*b*. For example, a low voltage power source circuit board 80, a main circuit board 81, which is for performing overall control of the printer 1, a relay circuit board 82, and a high voltage power source circuit board 83 are disposed in the lower compartment 100 below the lower partition 2*b*.

Each of the circuit boards 80 to 83 is fixed to stay portions 84 by screws, for example. The stay portions 84 are integrally formed with the lower partition 2*b* so as to protrude downward therefrom to a position above the bottom plate 87 so that an appropriate distance is maintained between the upper surface of the bottom plate 87 and the lower surfaces of the circuit boards 80 to 83. As a result, air passages are formed between the lower partition 2*b* and the upper surfaces of circuit boards 80 to 83.

Figure 4:
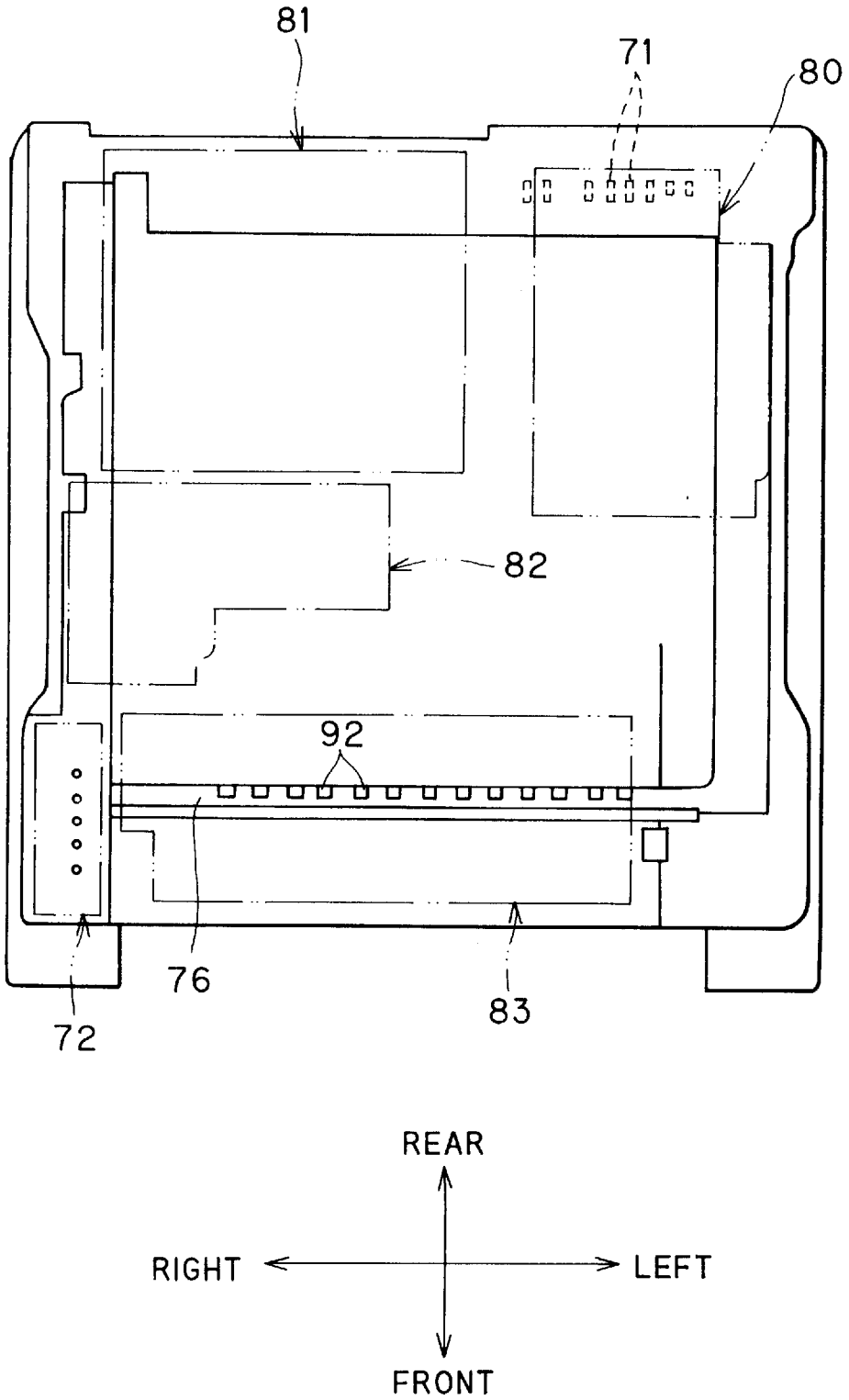
FIG. 4 is a plan view schematically showing the under surface of the housing case.

As shown in FIG. 4, the low voltage power source circuit board 80 is disposed at the rear left of the printer 1. The main circuit board 81 is disposed at the right rear side of the printer 1. The relay circuit board 82 is disposed on the left center of the printer 1. The high voltage power source circuit board 83 is disposed at the front of the printer 1 at a position substantially beneath the airflow duct 76.

Next, an explanation will be provided for cooling effects of the air-cooled type cooling device having the above-described configuration. When the power of the printer 1 is turned on, electric power is supplied to each of the circuit boards 80 to 83. Accordingly, a voltage is applied to a heater portion of the heating roller 51 to preheat the heating roller 51. At substantially the same time, drive of the cooling fan 72 is started.

Rotation of the cooling fan 72 generates a number of air streams throughout the printer 1. The air streams are indicated by arrows in the drawings and will be referred to by the corresponding letter hereinafter.

For example, as shown in FIG. 6, rotation of the cooling fan 72 draws air into the cooling fan housing portion 73 through the connecting passage 77 as air stream X and through the openings 78 as the air stream Y. Air streams X and Y are then discharged out through the outlet vent 74.

As shown in FIGS. 3 and 6, rotation of the cooling fan 72 draws air into the printer 1 through the first inlet vent 70 formed on the left side surface of the outer-cover lateral sides 2*c*, thereby generating an air stream A. Without passing through the airflow duct 76, the air stream A flows substantially above the fixing unit 50 while taking away heat generated therefrom. The air stream A further flows as air stream Y into the cooling fan housing portion 73 via the openings 78 and is finally discharged from the printer 1 through the outlet vent 74 formed in the right outer-cover lateral side 2*c*. In other words, the process unit 30, the fixing unit 50, and the top cover 61 form a substantially linear air passage from the inlet vent 70 to the openings 78, the cooling fan 72, and the outlet vent 74. Because of this linear arrangement, air flows extremely smoothly so that the fixing unit 50 can be effectively cooled off.

As shown in FIG. 5, air is also drawn into the printer 1 through the second inlet vent 71 formed on the rear outer-cover lateral side 2*c* of the housing case 2, thereby generating air streams B and C.

The air stream C from the second inlet vent 71 flows through the lower compartment 100 under the lower partition 2*b*. The air stream C flows substantially in parallel with the upper and lower surfaces of the low voltage power source circuit board 80, the main circuit board 81, the relay circuit board 82, and the high voltage power source circuit board 83 until it is finally discharged through the outlet vent 74 by the cooling fan 72 in the cooling fan housing portion 73. Because the circuit boards, such as those for power sources, are separated by the lower partition 2*b* from image forming components, that is, the scanner unit 20, the process unit 30, and the fixing unit 50, located above the lower partition 2*b*, heat generated in each of the units will not affect the circuit boards. Additionally, cooling air flowing through the lower compartment 100 under the lower partition 2*b* can reliably cool off the circuit boards.

Air stream B flows through the rear-side intake hole 86 and above the lower partition 2*b* toward the front of the printer 1. Air stream B splits at the process unit 30 to flow above the process unit 30 as air stream B" and below the process unit 30 as air stream B'. As shown in FIGS. 3 and 5, air flow B" flows toward the openings 78 in the right side of the process unit 30, where the cooling fan 72 in the cooling fan housing portion 73 discharges the air through the outlet vent 74.

On the other hand, air stream B' flows under the process unit 30, that is, between the process unit 30 and the scanner unit 20. The dividing member 93 prevents air stream B' from flowing over the upper surface plate 76*a* of the airflow duct 76 and guides the air stream B' into the airflow duct 76 through the process-unit-side intake holes 92. Then, as shown in FIG. 6, the air stream B' flows through the airflow duct 76 and, as air stream X, into the cooling fan housing portion 73 through the connecting passage 77, whereupon it is discharged from the outlet vent 74 by the cooling fan 72.

As shown in FIG. 8, rotation of the cooling fan 72 also draws air into the printer 1 through the cut-out portion 88 of the front surface of the housing case 2, thereby generating an air stream D under the fixing unit 50. The air stream D flows between the lower surface of the fixing unit 50 and the upper surface of the lower partition 2*b*, and is then drawn into the airflow duct 76 through the fixing-unit-side intake holes 89 formed on the front surface of the upper surface plate 76*a*. Air stream D than flows, as air stream X, into the cooling fan housing portion 73 through the connecting passage 77, whereupon it is discharged from the outlet vent 74 by the cooling fan 72.

The air stream D and the upper surface plate 76*a*, which blocks radiant heat generated in the fixing unit 50, enhance cooling effects of the cooling fan 72. Further, the heat-blocking effect of the heat-reflecting plate 90, which covers the front surface of the upper surface plate 76*a*, is also enhanced.

Air streams A, B including B' and B", C, and D generated in this manner flow through most every area in the main frame 2*a* toward the openings 78 and the connecting passage 77 without colliding with each other. As a result, not only does the upper surface plate 76*a* insulate the process unit 30 from radiant heat generated by the fixing unit 50, but it additionally serves to enhance cooling effects of the cooling fan 72 by preventing the air streams A to D from colliding with each other.

Because the housing case 2 is integrally formed from a compound resin with the main frame 2*a*, the outer-cover lateral sides 2*c*, the operation panel 2*d*, and the airflow duct 76, the housing case 2 can be easily assembled and fewer components are required, thereby reducing manufacturing costs.

What is claimed is:

1. A cooling unit for an image forming device including a process unit having a photosensitive body on which is formed an electrostatic latent image and a developing unit for forming a toner image on the photosensitive body based on the electrostatic latent image, a transfer unit that transfers the toner image onto a sheet, and a fixing unit that thermally fixes the toner image onto the sheet, the process unit and the fixing unit having facing surfaces that face each other, the cooling unit comprising:

an airflow duct disposed between the facing surfaces of the process unit and the fixing unit, the airflow duct being formed with holes facing at least one of the process unit and the fixing unit; and a cooling fan that draws air from around at least one of the process unit and the fixing unit through the holes formed in the airflow duct, and out of the image forming devices;

wherein the airflow duct has:

a tube-like portion that extends in a direction following the facing surfaces of the process unit and the fixing unit; and lengthwise ends at opposite ends of the tube-like portion, the lengthwise ends not facing the facing surfaces of the process unit and the fixing unit;

the cooling unit further comprising a housing case that houses components of the image forming device, the housing case including first and second lateral sides each facing a different one of the lengthwise ends of the airflow duct, the first lateral side being formed with an inlet vent and the second lateral side being formed with an outlet vent, the cooling fan being disposed adjacent to the outlet vent so as to blow air from within the housing case out of the outlet vent.

2. A cooling unit as claimed in claim 1, wherein the housing case is formed as an integral unit.

3. A cooling unit as claimed in claim 1, wherein the airflow duct is formed with process-unit-side holes facing the process unit, the cooling fan drawing air from around the process unit through the process-unit-side holes, through the airflow duct, and out of the image forming device.

4. A cooling unit as claimed in claim 1, wherein the airflow duct is formed with fixing-unit-side holes facing the fixing unit, the cooling fan drawing air from around the fixing unit through the fixing-unit-side holes, through the airflow duct, and out of the image forming device.

5. A cooling unit as claimed in claim 1, wherein the lengthwise end of the airflow duct facing the inlet vent is sealed so that air drawn through the inlet vent by the cooling fan passes over the airflow duct, past the fixing unit, and toward the outlet vent.

6. A cooling unit as claimed in claim 1, wherein the housing case further includes a cover disposed over the process unit so as to form an air passage between the cover and the process unit, the air passage extending from the inlet vent to the outlet vent so that air drawn in through the inlet vent passes by the process unit and the fixing unit via the air passage.

7. A cooling unit as claimed in claim 1, wherein the airflow duct is formed with process-unit-side holes facing the process unit and fixing-unit-side holes facing the fixing unit, the cooling fan drawing air from around the process unit and the fixing unit through the process-unit-side and the fixing-unit-side holes, through the airflow duct, and out of the image forming device.

8. A cooling unit as claimed in claim 7, wherein the lengthwise end of the airflow duct facing the inlet vent is sealed so that air drawn through the inlet vent by the cooling fan passes over the airflow duct toward the outlet vent.

9. A cooling unit as claimed in claim 7, wherein the housing case further includes a cover disposed over the process unit and the fixing unit, the cover, the process unit, and the fixing unit disposed so as to form an air passage that extends from the inlet vent to the outlet vent so that air drawn in through the inlet vent passes by the process unit and the fixing unit via the air passage.

10. A cooling unit as claimed in claim 9, wherein the housing case further includes:

a separation wall disposed opposite the second lateral side with the cooling fan disposed therebetween, thereby forming a cooling fan housing area between the separation wall and the second lateral side, the separation wall being formed with first and second through holes, the first through hole bringing the cooling fan housing area into fluid communication with the air passage and the second through hole bringing the cooling fan housing area into fluid communication with the airflow duct.

11. A cooling unit as claimed in claim 9, wherein the housing case further includes:

a third lateral side opposite the airflow duct with the process unit disposed therebetween, the third lateral side being formed with an additional inlet vent disposed with respect to the outlet vent so that the cooling fan draws air from outside the image forming device in through the additional inlet vent, passed the process unit, and out through the outlet vent.

12. A cooling unit as claimed in claim 11, wherein the housing case further includes:

a bottom plate; and a partition that separates the process unit from at least a circuit board of the image forming device, the partition forming a channel in cooperation with the bottom plate, the additional inlet vent and the outlet vent being positioned with respect to the partition so that the cooling fan draws air in through the additional inlet vent, through the channel, passed the circuit board, and out through the outlet vent.

13. A cooling unit as claimed in claim 12, wherein the second lateral side and the third lateral side are disposed substantially at right angles to each other, the additional inlet vent being disposed diagonally to the outlet vent so that air drawn in through the inlet vent by the cooling fan passes by the process unit.

14. A cooling unit as claimed in claim 11, wherein the additional inlet vent and the outlet vent are positioned with respect to the process unit so that the cooling fan draws air through the additional inlet vent to flow over and under the process unit, the air flowing under the process unit being drawn into the airflow duct via the process-unit-side holes, the air flowing over the process unit being drawn directly to the outlet vent without passing through the airflow duct.

15. A cooling unit as claimed in claim 14, further comprising a dividing member disposed between the process unit and the airflow duct at a position above the process-unit-side holes, the dividing member guiding air flowing from the inlet vent under the process unit into the process-unit-side holes, thereby preventing air flowing from the inlet vent under the process unit from colliding with air flowing from the inlet vent over the process unit.

16. A cooling unit as claimed in claim 2, further comprising a housing case that houses components of the image forming device, the housing case including:

a first lateral side formed with an outlet vent, the cooling fan being disposed adjacent to the outlet vent so as to discharge air out of the outlet vent; and a second lateral side opposite the airflow duct with the process unit disposed therebetween, the second lateral side being formed with an inlet vent, the cooling fan drawing air from outside the image forming device in through the inlet vent, passed the process unit, and out through the outlet vent.

17. A cooling unit as claimed in claim 16, wherein the inlet and outlet vents are positioned with respect to the process unit so that the cooling fan draws air through the inlet vent to flow over and under the process unit, the air flowing under the process unit being drawn into the airflow duct via the process-unit-side holes, the air flowing over the process unit being drawn directly to the outlet vent without passing through the airflow duct.

18. A cooling unit as claimed in claim 16, wherein the housing case further includes:

a bottom plate; and a partition that separates the process unit from at least a circuit board of the image forming device, the partition forming a channel in cooperation with the bottom plate, the inlet and outlet vents being positioned with respect to the partition so that the cooling fan draws air in through the inlet vent, through the channel, past the circuit board, and out of the outlet vent.

19. A cooling unit as claimed in claim 7, further comprising:

a housing case housing components of the image forming device, the housing case including:

a first lateral side formed with an outlet vent, the cooling fan being disposed adjacent to the outlet vent so as to blow air out of the outlet vent;

a second lateral side opposite the airflow duct with the process unit disposed therebetween, the second lateral side being formed with an inlet vent;

a bottom plate; and a partition that separates the process unit from at least a circuit board of the image forming device, the partition forming a channel in cooperation with the bottom plate, the inlet and outlet vents being positioned with respect to the partition so that the cooling fan draws air in through the inlet vent, through the channel, past the circuit board, and out through the outlet vent.

20. A cooling unit as claimed in claim 19, further comprising thermal insulation covering a surface of the airflow duct confronting the fixing unit.

21. A cooling unit as claimed in claim 19, wherein the housing case further includes a third lateral side opposite the airflow duct with the fixing unit disposed therebetween, the third lateral side being formed with an opening through which air passes below the fixing unit and into the airflow duct through the fixing-unit-side holes.

22. A cooling unit as claimed in claim 19, wherein the first lateral side and the second lateral side are disposed substantially at right angles to each other, the inlet vent being disposed diagonally to the outlet vent so that air drawn in through the inlet vent by the cooling fan passes by the process unit.

23. A cooling unit as claimed in claim 7, further comprising a housing case that houses components of the image forming device, the housing case including a lateral side opposite the airflow duct with the fixing unit disposed therebetween, the lateral side being formed with an opening through which air passes below the fixing unit and into the airflow duct through the fixing-unit-side holes.

24. A cooling unit as claimed in claim 7, wherein the airflow duct thermally insulates the process unit from heat generated by the fixing unit.

25. A cooling unit as claimed in claim 24, further comprising thermal insulation covering a surface of the airflow duct confronting the fixing unit.

26. An image forming device comprising:

a process unit having a photosensitive body on which is formed an electrostatic latent image and a developing unit for forming a toner image on the photosensitive body based on the electrostatic latent image;

a transfer unit that transfers the toner image onto a sheet;

a fixing unit that thermally fixes the toner image onto the sheet, the process unit and the fixing unit having facing surfaces that face each other;

an airflow duct disposed between the facing surfaces of the process unit and the fixing unit, the airflow duct being formed with process-unit-side holes facing the process unit and fixing-unit-side holes facing the fixing unit; and a cooling fan that draws air from around the process unit and the fixing unit through the process-unit-side and fixing-unit-side holes, through the airflow duct, and out of the image forming device;

wherein the airflow duct has:

a tube-like portion that extends in a direction following the facing surfaces of the process unit and the fixing unit; and lengthwise ends at opposite ends of the tube-like portion, the lengthwise ends not facing the facing surfaces of the process unit and the fixing unit;

the cooling unit further comprising a housing case that houses components of the image forming device, the housing case including first and second lateral sides each facing a different one of the lengthwise ends of the airflow duct, the first lateral side being formed with an inlet vent and the second lateral side being formed with an outlet vent, the cooling fan being disposed adjacent to the outlet vent so as to blow air from within the housing case out of the outlet vent.

27. A cooling unit for an image forming device including a process unit having a photosensitive body on which is formed an electrostatic latent image and a developing unit for forming a toner image on the photosensitive body based on the electrostatic latent image, a transfer unit that transfers the toner image onto a sheet, and a fixing unit that thermally fixes the toner image onto the sheet, the process unit and the fixing unit having facing surfaces that face each other, the cooling unit comprising:

an airflow duct disposed between the facing surfaces of the process unit and the fixing unit, the airflow duct being formed with holes facing at least the process unit;

a cooling fan that draws air from around at least the process unit through the holes formed in the airflow duct, and out of the image forming device;

a housing case that houses at least the airflow duct and the cooling fan, the housing case including:

a first lateral side formed with an outlet vent, the cooling fan being disposed adjacent to the outlet vent so as to discharge air out of the outlet vent; and a second lateral side opposite the airflow duct with the process unit disposed therebetween, the second lateral side being formed with an inlet vent, the cooling fan drawing air from outside the image forming device in through the inlet vent, past the process unit, and out through the outlet vent;

wherein the inlet and outlet vents are positioned with respect to the process unit so that the cooling fan draws air through the inlet vent to flow over and under the process unit, the air flowing under the process unit being drawn into the airflow duct through the holes, the air flowing over the process unit being drawn directly to the outlet vent without passing through the airflow duct.

28. A cooling unit for an image forming device including a process unit having a photosensitive body on which is formed an electrostatic latent image and a developing unit for forming a toner image on the photosensitive body based on the electrostatic latent image, a transfer unit that transfers the toner image onto a sheet, and a fixing unit that thermally fixes the toner image onto the sheet, the process unit and the fixing unit having facing surfaces that face each other, the cooling unit comprising:

an airflow duct disposed between the facing surfaces of the process unit and the fixing unit, the airflow duct being formed with holes facing at least one of the process unit and the fixing unit;

a cooling fan that draws air from around at least one of the process unit and the fixing unit through the holes formed in the airflow duct, and out of the image forming device; and a housing case housing at least the airflow duct and the cooling fan, the housing case including:

a first lateral side formed with an outlet vent, the cooling fan being disposed adjacent to the outlet vent so as to blow air out of the outlet vent;

a second lateral side opposite the airflow duct with the process unit disposed therebetween, the second lateral side being formed with an inlet vent;

a bottom plate; and a partition that separates the process unit from at least a circuit board of the image forming device, the partition forming a channel in cooperation with the bottom plate, the inlet and outlet vents being positioned with respect to the partition so that the cooling fan draws air in through the inlet vent, through the channel, past the circuit board, and out through the outlet vent.

* * * * *